US006087312A

United States Patent [19]

Masotti et al.

[11] Patent Number: 6,087,312

[45] Date of Patent: Jul. 11, 2000

[54] LAUNDRY BLEACHING PROCESSES AND COMPOSITIONS

[75] Inventors: Valentina Masotti, Casalecchio di Reno; Luca Sarcinelli; Stefano Scialla, both of Rome, all of Italy

[73] Assignee: The Procter & Gamble Company, Cincinnati, Ohio

[21] Appl. No.: 09/254,837

[22] PCT Filed: Sep. 10, 1997

[86] PCT No.: PCT/US97/15976

§ 371 Date: Mar. 13, 1999

§ 102(e) Date: Mar. 13, 1999

[87] PCT Pub. No.: WO98/11192

PCT Pub. Date: Mar. 19, 1998

[30] Foreign Application Priority Data

Sep. 13, 1996 [EP] European Pat. Off. ..... 96870115

[51] Int. Cl.[7] ..... C11D 3/395; C11D 3/44

[52] U.S. Cl. ..... 510/309; 510/283; 510/303; 510/342; 510/372; 252/186.42; 252/186.43; 8/111

[58] Field of Search ..... 252/186.42, 186.43; 8/111; 510/283, 303, 304, 309, 310, 342, 356, 372

[56] References Cited

U.S. PATENT DOCUMENTS

| | | | |
|---|---|---|---|
| 3,248,336 | 4/1966 | Blumbergs | 510/342 |
| 4,176,080 | 11/1979 | Wise et al. | 510/342 |
| 4,180,472 | 12/1979 | Mitchell et al. | 510/342 |
| 4,561,991 | 12/1985 | Herbots et al. | 510/283 |
| 4,767,563 | 8/1988 | deBuzzaccarini | 510/397 |
| 4,772,412 | 9/1988 | Green et al. | 510/371 |
| 4,877,556 | 10/1989 | Wilsberg et al. | 510/342 |
| 4,981,606 | 1/1991 | Barnes | 510/283 |
| 5,250,212 | 10/1993 | De Buzzaccarini et al. | 510/372 |
| 5,271,860 | 12/1993 | Schwadtke et al. | 510/342 |
| 5,328,489 | 7/1994 | Beaujean et al. | 510/342 |

FOREIGN PATENT DOCUMENTS

| | | | |
|---|---|---|---|
| 126545B1 | 11/1984 | European Pat. Off. | C11D 17/00 |
| 137616 | 4/1985 | European Pat. Off. | C11D 7/50 |
| 216416 | 4/1987 | European Pat. Off. | C11D 3/14 |

*Primary Examiner*—Caroline D. Liott

*Attorney, Agent, or Firm*—C. Brant Cook; Kim William Zerby; J. C. Rasser

[57] ABSTRACT

The present invention relates to the bleaching of fabrics with liquid compositions comprising a peroxygen bleach and a solvent system comprising a hydrophilic solvent and a hydrophobic solvent. These compositions deliver improved stain removal on a variety of stains including bleachable stains, greasy stains, enzymatic stains and mud/clay stains.

34 Claims, No Drawings

LAUNDRY BLEACHING PROCESSES AND COMPOSITIONS

TECHNICAL FIELD

The present invention relates to the bleaching of fabrics.

BACKGROUND

A great variety of cleaning compositions have been described in the art. A problem associated with common cleaning compositions, when used in laundry application to treat different kinds of fabrics, including cotton and synthetic fabrics such as polyesters, polyamides and the like, is that they do not deliver an effective performance satisfactorily meeting consumer's needs, on all types of stains including greasy stains, enzymatic stains, mud/clay stains and the like.

It is thus an object of the present invention to provide overall improved stain removal performance on a wide range of stains while delivering excellent bleaching performance.

It has now been found that this object can be met by bleaching fabrics with a liquid composition comprising a peroxygen bleach and a solvent system comprising a hydrophobic solvent, i.e., a solvent having a hydrophilic index of less than 18, and a hydrophilic solvent, i.e., a solvent having a hydrophilic index of more than 18, wherein the hydrophilic index is defined by the following equation:

$$\frac{\text{molecular weight of the hydrophilic part of the solvent}}{\text{total molecular weight of the solvent}} * 100$$

Indeed, it has been found that liquid compositions comprising a peroxygen bleach and such a solvent system, when used in a laundry operation, boost the removal of various types of stains including greasy stains, mud/clay-containing stains, enzymatic stains, as well as bleachable stains.

An advantage of the present invention is that excellent performance is provided in a variety of laundry applications, e.g., laundry detergent, or laundry additive, and preferably laundry pretreater.

In a preferred embodiment of the present invention the liquid compositions used herein may also comprise a bleach activator, which will react in an aqueous medium with hydrogen peroxide to form the corresponding peracid. It has been observed that this peracid is more effective at lower temperatures, e.g., at those temperatures where the pretreatment operation is usually performed (20° C.–25° C.), and thus allows the compositions herein to deliver more effective bleaching performance across a wider range of temperatures.

Another advantage of a particular embodiment of the present invention is that when such a solvent system, as described herein, is added in a liquid bleaching composition of the present invention formulated as an emulsion or a microemulsion, the viscosity of said composition is reduced, whatever the viscosity was before the addition of said solvent system. Thus, in one embodiment the present invention also provides liquid emulsions or microemulsions comprising a peroxygen bleach and a solvent system, as described herein, wherein the viscosity can be conveniently controlled while maintaining adequate physical stability, without the need to add any viscosity control agent which would raise the formula cost, and add bulk to the compositions without contributing to the bleaching/cleaning performance of said compositions.

EP-A-126545 discloses liquid scouring cleaners comprising an abrasive, at least 0.1% of terpene (e.g., d-limonene), at least 0.1% of benzyl alcohol and optionally surfactants, builders and the like. The compositions clean both greasy and particle soils from hard surfaces. No bleaches are disclosed. No laundry application is disclosed.

EP-A-216416 discloses liquid scouring cleansers (pH 8–12) with paraffin sulfonate and alkyl benzene sulfonate, 0.5%–10% of a mono- or sesquiterpene, 0.5%–3% of a polar solvent, an acrylic polymeric thickener, an abrasive and a viscosity enhancing compound. No bleaches are disclosed. No laundry application is disclosed.

EP-A-137616 discloses laundry liquid compositions formulated in the form of an emulsion having a pH of 6.5 or above and comprising at least 5% by weight of solvents. Such solvents include terpene and terpenoid solvents (e.g., pinene, d-limonene) as well as other solvents like benzyl alcohol, n-hexanol, paraffins. Mixtures of orange terpenes and benzyl alcohol are especially suitable for removing certain types of stains like dirty motor oil. The addition of non-polar solvents like benzyl alcohol, n-hexanol, mixed fatty alcohols, increases the stability. Pretreating of fabrics and through the wash treatment with such compositions are disclosed. No bleaches are disclosed.

SUMMARY OF THE INVENTION

The present invention encompasses a process of bleaching a fabric with a liquid composition comprising a peroxygen bleach and a solvent system comprising a hydrophilic solvent having a hydrophilic index of more than 18, and a hydrophobic solvent having a hydrophilic index of less than 18, wherein the hydrophilic index is defined by the equation molecular weight of the hydrophilic part of the solvent $$\frac{\text{molecular weight of the hydrophilic part of the solvent}}{\text{total molecular weight of the solvent}} * 100,$$

said process comprising the steps of applying said composition in its neat form onto said fabric, preferably only soiled portions thereof, before rinsing, or washing then rinsing said fabric.

The present invention also encompasses a process of bleaching fabrics which includes the steps of diluting in an aqueous bath a liquid composition in its neat form, comprising a peroxygen bleach and a solvent system as defined hereinabove, contacting said fabrics with said aqueous bath comprising said liquid composition, and subsequently rinsing, or washing then rinsing said fabrics.

Finally, the present invention encompasses a liquid composition suitable for bleaching fabrics, comprising a peroxygen bleach, and a solvent system comprising from 0.05% to 20% by weight of the total composition of a hydrophilic solvent having a hydrophilic index of more than 18, and from 0.05% to 10% by weight of the total composition of a hydrophobic solvent having a hydrophilic index of less than 18, wherein the hydrophilic index is defined by the equation $$\frac{\text{molecular weight of the hydrophilic part of the solvent}}{\text{total molecular weight of the solvent}} * 100.$$

DETAILED DESCRIPTION OF THE INVENTION

Processes for Bleaching a Fabric

The present invention encompasses processes of bleaching fabrics, starting from a liquid bleaching composition comprising a peroxygen bleach and a solvent system comprising a hydrophobic solvent and a hydrophilic solvent, as described herein.

Indeed, the present invention is based on the finding that by adding the present solvent system, in a liquid composition comprising a peroxygen bleach, improved stain removal performance is obtained with said composition when used to treat a soiled fabric, especially in pretreatment application, as compared to the stain removal performance delivered with the same composition without said solvent system, or comprising only one type of solvent, i.e., a hydrophilic solvent or a hydrophobic solvent as described herein, instead of said solvent system comprising both a hydrophilic solvent and a hydrophobic solvent.

By "stain removal performance" it is meant herein stain removal performance on a variety of stains/soils such as greasy/oily stains, and/or enzymatic stains and/or mud/clay stains as well as on bleachable stains.

By "greasy/oily stains" it is meant herein any soil and stain of greasy nature that can be found on a fabric like dirty motor oil, mineral oil, make-up, lipstick vegetal oil, spaghetti sauce, mayonnaise and the like. Indeed, the liquid compositions herein have been found to be particularly effective on make-up and spaghetti sauce.

Examples of enzymatic stains include grass, chocolate and blood. Examples of bleachable stains include tea, coffee, wine and the like.

The stain removal performance of a given composition on a soiled fabric, for example under pretreatment conditions, may be evaluated by the following test method. A composition according to the present invention is first applied neat on the stained portion of a fabric, left to act thereon from about 1 to about 10 minutes, preferably 5 minutes, after which the pretreated fabric is washed according to common washing conditions with a conventional detergent composition, at a temperature of from 30° C. to 70° C. for a period of time sufficient to bleach said fabric. For example, typical soiled fabrics to be used in this stain removal performance test may be commercially available from EMC (Empirical Manufacturing Company) Cincinnati, Ohio, USA, such as clay, grass, spaghetti sauce, gravy, dirty motor oil, make-up, barbecue sauce, tea, blood on two different substrates: cotton (CW120) and polycotton (PCW28).

The stain removal performance may be evaluated by comparing side by side the soiled fabrics pretreated with the composition according to the present invention with those pretreated with the reference, e.g. the same composition without such a solvent system according to the present invention. A visual grading scale may be used to assign differences in panel score units (psu), in a range from 0 to 4.

The processes of bleaching fabrics of the present invention include the steps of contacting fabrics with a liquid bleaching composition comprising a peroxygen bleach and a solvent system, as described herein, neat or diluted, and subsequently rinsing said fabrics. In the preferred embodiment, when the fabrics are "pretreated", the composition is applied neat on the fabrics, and the fabrics are subsequently rinsed, or washed and then rinsed in a normal wash cycle. We have observed that the stain removal performance improvement is particularly noticeable with the compositions used herein when contacted directly with the soiled portion of fabrics, before they are washed/rinsed.

As a first essential element, the liquid compositions used according to the present invention comprise a peroxygen bleach or mixtures thereof. Such peroxygen bleaches include hydrogen peroxide, or a water soluble source thereof, or mixtures thereof. Indeed, the presence of a peroxygen bleach, preferably hydrogen peroxide and/or hydroperoxide and/or aliphatic diacyl peroxide, contributes to the excellent cleaning and bleaching benefits of the compositions of the present invention. As used herein a hydrogen peroxide source refers to any compound which produces perhydroxyl ions when said compound is in contact with water.

Suitable water-soluble sources of hydrogen peroxide for use herein include percarbonates, persilicate, persulphate such as monopersulfate, perborates, peroxyacids such as diperoxydodecandioic acid (DPDA), magnesium perphtalic acid, perbenzoic and alkylperbenzoic acids, alkyl hydroperoxides, peroxides, aliphatic diacyl peroxides and mixtures thereof. Hydrogen peroxide and/or alkyl hydroperoxides and/or aliphatic diacyl peroxides are preferred to be used in the compositions according to the present invention.

Suitable hydroperoxides for use herein are tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide. Such hydroperoxides have the advantage to be particularly safe to fabrics and color while delivering excellent bleaching performance.

Suitable aliphatic diacyi peroxides for use herein are dilauroyl peroxide, didecanoyl peroxide, dimyristoyl peroxide or mixtures thereof. Such aliphatic diacyl peroxides have the advantage to be particularly safe to fabrics and color while delivering excellent bleaching performance.

Typically, the compositions herein comprise from 0.01% to 20% by weight of the total composition of a peroxygen bleach, or mixtures thereof, preferably from 1% to 10%, and more preferably from 4% to 7%.

As a second essential element, the liquid compositions used according to the present invention comprise a solvent system comprising a hydrophobic solvent and a hydrophilic solvent.

By "solvent" it is meant herein any hydrocarbon including aliphatic saturated or unsaturated hydrocarbons or aromatic hydrocarbons that contain or not, one or more alcoholic groups, one or more ether groups and/or one or more ketone groups.

To define the hydrophilic or hydrophobic character of a solvent herein, the following hydrophilic index (HI) is used:

$$\frac{\text{molecular weight of the hydrophilic part of the solvent}}{\text{total molecular weight of the solvent}} * 100$$

By "hydrophilic part" of a given solvent it is meant herein all the groups O, CO, OH, of a given solvent.

By "molecular weight of the hydrophilic part of a solvent" it is meant herein the total molecular weight of all the hydrophilic parts of a given solvent.

The hydrophilic solvents to be used herein have a hydrophilic index of more than 18, preferably more than 25, and more preferably more than 30, and the hydrophobic solvents to the used herein have a hydrophilic index of less than 18, preferably less than 17 and more preferably 16 or less.

The combination of these solvents provides improved overall stain removal performance when added in a liquid peroxygen bleach-containing composition on various type of stains like greasy stains (e.g. dirty motor oil), enzymatic stains (e.g. blood) and clay stains. Furthermore, this solvent system when added in a liquid peroxygen bleach-containing composition, further provides improved bleaching efficacy. It is speculated that said solvents can be a vehicle to the other active ingredients present in said liquid compositions, helping them to penetrate the stains. Indeed, the hydrophobic solvent can be a vehicle for hydrophobic active ingredients like hydrophobic bleaches (e.g., dilauroyl peroxide), while the hydrophilic solvent can be a vehicle for hydrophilic bleaches like hydrogen peroxide.

Suitable hydrophobic solvents to be used herein include paraffins, terpenes or terpene derivatives, as well as alkoxylated aliphatic or aromatic alcohols, aliphatic or aromatic alcohols, glycols or alkoxylated glycols, and mixtures thereof, all these solvents have a hydrophilic index of less than 18.

Suitable terpenes (hydrophilic index of O) are mono-and bicyclic monoterpenes, especially those of the hydrocarbon class, which include the terpinenes, terpinolenes, limonenes and pinenes and mixtures thereof.

Highly preferred materials of this type are d-limonene, dipentene, alpha-pinene and/or beta-pinene. For example, pinene is commercially available form SCM Glidco (Jacksonville) under the name Alpha Pinene P&F®.

Terpene derivatives such as alcohols, aldehydes, esters, and ketones which have a hydrophilic index of less than 18 can also be used herein. Such materials are commercially available as, for example, the α and β isomers of terpineol and linalool.

All type of paraffins (hydrophilic index of O) can be used herein, both linear and not, containing from 2 to 20 carbons, preferably from 4 to 10, more preferably from 6 to 8. Preferred herein is octane. Octane is commercially available for example from BASF.

Suitable hydrophobic alkoxylated aliphatic or aromatic alcohols to be used herein are according to the formula R $(A)_n$—OH wherein R is a linear or branched saturated or unsaturated alkyl group, or alkyl substituted or non-alkyl substituted aryl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Suitable hydrophobic alkoxylated alcohol to be used herein is 1-methoxy-11-dodecanol (HI=15).

Suitable hydrophobic aliphatic or aromatic alcohols to be used herein are according to the formula R—OH wherein R is a linear or branched saturated or unsaturated alkyl group, or alkyl substituted or non-alkyl substituted aryl group of from 1 to 20 carbon atoms, preferably from 2 to 15 and more preferably from 2 to 10. Suitable aliphatic alcohols to be used herein include linear alcohols like decanol (HI=7). Suitable aromatic alcohol to be used herein is benzyl alcohol (HI=16).

Suitable hydrophobic glycols to be used herein are according to the formula HO—CR1R2—OH wherein R1 and R2 are independently H or a C2–C10 saturated or unsaturated aliphatic hydrocarbon chain and/or cylic. Suitable glycol to be used herein is dodecaneglycol (HI=16).

Suitable hydrophobic alkoxylated glycols to be used herein are according to the formula R—(A)n—R1—OH wherein R is H, OH, a linear saturated or unsaturated alkyl of from 1 to 20 carbon atoms, preferably from 2 to 15 and more preferably from 2 to 10, wherein R1 is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycol to be used herein is methoxy octadecanol (HI=11).

Particularly preferred hydrophobic solvents to be used herein include d-limonene, dipentene, alpha-pinene, beta-pinene, octane, benzyl alcohol, or mixtures thereof.

Suitable hydrophilic solvents to be used herein include alkoxylated aliphatic or aromatic alcohols, aliphatic or aromatic alcohols, glycols or alkoxylated glycols, and mixtures thereof, all these solvents having a hydrophilic index of more than 18.

Suitable hydrophilic alkoxylated aliphatic or aromatic alcohols to be used herein are according to the formula R $(A)_n$—OH wherein R is a linear or branched saturated or unsaturated alkyl group, or alkyl substituted or non-alkyl substituted aryl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Particularly suitable alkoxylated alcohols to be used herein include methoxy propanol (HI=37), ethoxy propanol (HI=32), propoxy propanol (HI=28) and/or buthoxy propanol (HI=27).

Suitable hydrophilic aliphatic or aromatic alcohols to be used herein are according to the formula R—OH wherein R is a linear or branched saturated or unsaturated alkyl group, or alkyl substituted or non-alkyl substituted aryl group of from 1 to 20 carbon atoms, preferably from 2 to 15 and more preferably from 2 to 10. Particularly suitable aliphatic alcohols to be used herein include linear alcohols like ethanol (HI=37) and/or propanol (HI=28).

Suitable hydrophilic glycols to be used herein are according to the formula HO—CR1R2—OH wherein R1 and R2 are independently H or a C2–C10 saturated or unsaturated aliphatic hydrocarbon chain and/or cylic. Particularly suitable glycol to be used herein is propanediol (HI=45).

Suitable hydrophilic alkoxylated glycols to be used herein are according to the formula R—(A)n—R1—OH wherein R is H, OH, a linear saturated or unsaturated alkyl group of from 1 to 20 carbon atoms, preferably from 2 to 15 and more preferably from 2 to 10, wherein R1 is H or a linear saturated or unsaturated alkyl group of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Particularly suitable alkoxylated glycols to be used herein is ethoxyethoxyethanol (HI=37).

Typically, the compositions to used herein comprise from 0.05% to 10% by weight of the total composition of said hydrophobic solvent or mixtures thereof, preferably from 0.1% to 5% and more preferably from 0.2% to 2%, and from 0.05% to 20% by weight of the total composition of said hydrophilic solvent or mixtures thereof, preferably from 0.5% to 15% and more preferably from 1% to 10%. Indeed, best overall stain removal performance has been obtained on different stains including bleachable stains, greasy stains, mud/clay stains and enzymatic-type stains, when said solvents are present in a weight ratio of said hydrophobic solvent to said hydrophilic solvent of from 1:20 to 1:1, more preferably from 1:14 to 1:2.

The compositions to be used according to the present invention must be liquids. As used herein, "liquid" includes "pasty" compositions, and liquid compositions herein preferably have a viscosity of from 1 cps to 10000 cps, preferably from 100 cps to 1000 cps, more preferably from 200 cps to 600 cps, at 50 rpm shear rate and at 20° C. temperature.

Preferably, the compositions to be used herein are aqueous. Said aqueous compositions have a pH as is of from 1 to 12, preferably from 2 to 6, and more preferably from 3 to 5, where optimum chemical stability is achieved. The pH of the compositions can be adjusted for instance by using organic or inorganic acids, or alkalinizing agents.

The compositions used in the present invention may further comprise optional ingredients like surfactants including nonionic, anionic, cationic, zwitterionic and/or amphotheric surfactants, builders, stabilizers, chelants, soil suspending polyamine polymers, polymeric soil release agents, dye transfer agents, radical scavengers, solvents, brighteners, catalysts, foam suppresors, bleach activators, perfumes and dyes.

In the present invention, the liquid bleaching composition comprising a peroxygen bleach and said solvent system needs to be contacted with the fabrics to be bleached. This can be done either in a so-called "pretreatment mode", where the composition is applied neat onto said fabrics before the fabrics are rinsed, or washed then rinsed, or in a "soaking mode" where the liquid composition is first diluted in an aqueous bath and the fabrics are immersed and soaked in the bath, before they are rinsed, or in a "through the wash mode", where the liquid composition is added on top of a wash liquor formed by dissolution or dispersion of a typical laundry detergent. As discussed earlier, the composition to perform the processes herein is in the form of a liquid as opposed to a solid or a gas.

It is also essential in these processes according to the present invention, that the fabrics be rinsed after they have been contacted with said composition, before said composition has completely dried off. In the pretreatment mode, it has been found that water evaporation contributes to increase the concentration of free radicals onto the surface of the fabrics and, consequently, the rate of chain reaction. Indeed, free radicals typically result from the decomposition of peroxygen bleach that may be catalyzed due to the presence of metal ions on the surface of a fabric and/or to the exposure of the fabrics to UV radiation from sunlight. It is also speculated that an auto-oxidation reaction occurs upon evaporation of water when liquid peroxygen-bleach containing compositions are left to dry onto the fabrics. Said reaction of auto-oxidation generates peroxy-radicals which may contribute to the degradation of cellulose. Thus, not leaving the liquid compositions, as described herein, to dry onto the fabric, in a process of pretreating soiled fabrics, contributes to reduce the tensile strength loss when pretreating fabrics with liquid peroxygen bleach-containing compositions.

In the pretreatment mode, the process comprises the steps of applying said liquid composition in its neat form onto said fabrics, or at least soiled portions thereof (i.e., directly applying said liquid composition as described herein onto said fabrics without undergoing any dilution), and subsequently rinsing, or washing then rinsing said fabrics. In this mode, the neat compositions can optionally be left to act onto said fabrics for a period of time ranging from 1 min. to 1 hour, preferably from 1 minute to 30 minutes, before the fabrics are rinsed, or washed then rinsed, provided that the composition is not left to dry onto said fabrics. For particularly though stains, it may be appropriate to further rub or brush said fabrics by means of a sponge or a brush, or by rubbing two pieces of fabrics against each other.

In another mode, generally referred to as "soaking", the process comprises the steps of diluting said liquid-composition in its neat form in an aqueous bath so as to form a diluted composition. The dilution level of said liquid composition in an aqueous bath is typically up to 1:85, preferably up to 1:50 and more preferably about 1:25 (composition:water). The fabrics are then contacted with the aqueous bath comprising the liquid composition, and the fabrics are finally rinsed, or washed then rinsed. Preferably in that embodiment, the fabrics are immersed in the aqueous bath comprising the liquid composition, and also preferably, the fabrics are left to soak therein for a period of time ranging from 30 minutes to 48 hours, preferably from 1 hour to 24 hours.

In yet another mode which can be considered as a sub-embodiment of "soaking", generally referred to as "bleaching through the wash", the liquid composition is used as a so-called laundry additive. And in that embodiment the aqueous bath is formed by dissolving or dispersing a conventional laundry detergent in water. The liquid composition in its neat form is contacted with the aqueous bath, and the fabrics are then contacted with the aqueous bath containing the liquid composition. Finally, the fabrics are rinsed.

Liquid Compositions

The present invention also encompasses a liquid composition suitable for bleaching fabrics, comprising a peroxygen bleach, and a solvent system comprising from 0.05% to 20% by weight of the total composition of a hydrophilic solvent having a hydrophilic index of more than 18, and from 0.05% to 10% by weight of the total composition of a hydrophobic solvent having a hydrophilic index of less than 18, wherein the hydrophilic index is defined by the equation $$\frac{\text{molecular weight of the hydrophilic part of the solvent}}{\text{total molecular weight of the solvent}} * 100.$$

Said peroxygen bleach and solvent system are as described hereinbefore.

The liquid compositions of the present invention preferably further comprise a surfactant or mixtures thereof. Any surfactant known to those skilled in the art may be suitable herein including nonionic, anionic, cationic, zwitterionic, and/or amphoteric surfactants up to 50% by weight of the total composition. Surfactants allow to further improve the stain removal properties of the compositions according to the present invention.

Nonionic surfactants are highly preferred herein for performance reasons. The liquid compositions herein may comprise up to 50% of a nonionic surfactant or mixtures thereof, preferably from 0.3% to 30% and more preferably from 0.4% to 25%. Suitable nonionic surfactants to be used herein are fatty alcohol ethoxylates and/or propoxylates which are commercially available with a variety of fatty alcohol chain lengths and a variety of ethoxylation degrees. Indeed, the HLB values of such alkoxylated nonionic surfactants depend essentially on the chain length of the fatty alcohol, the nature of the alkoxylation and the degree of alkoxylation. Surfactant catalogues are available which list a number of surfactants, including nonionics, together with their respective HLB values.

Suitable chemical processes for preparing the nonionic surfactants for use herein include condensation of corresponding alcohols with alkylene oxide, in the desired proportions. Such processes are well-known to the man skilled in the art and have been extensively described in the art. As an alternative, a great variety of alkoxylated alcohols suitable for use herein is commercially available from various suppliers.

Particularly suitable to be used herein as nonionic surfactants are hydrophobic nonionic surfactants having an HLB (hydrophilic-lipophilic balance) below 16, preferably below 15, more preferably below 12, and most preferably below 10. Those hydrophobic nonionic surfactants have been found to provide good grease cutting properties.

Preferred hydrophobic nonionic surfactants to be used in the compositions according to the present invention are surfactants having an HLB below 16 and being according to the formula $RO—(C_2H_4O)_n(C_3H_6O)_mH$, wherein R is a $C_6$ to $C_{22}$ alkyl chain or a $C_6$ to $C_{28}$ alkyl benzene chain, and wherein n+m is from 0 to 20 and n is from 0 to 15 and m is from 0 to 20, preferably n+m is from 1 to 15 and, n and m are from 0.5 to 15, more preferably n+m is from 1 to 10 and, n and m are from 0 to 10. The preferred R chains for use herein are the $C_8$ to $C_{22}$ alkyl chains. Accordingly, suitable hydrophobic nonionic surfactants for use herein are Dobanol$^R$ 91-2.5 (HLB=8.1; R is a mixture of C9 and $C_{11}$ alkyl chains, n is 2.5 and m is 0), or Lutensol$^R$ TO3 (HLB=8; R is a $C_{13}$ alkyl chains, n is 3 and m is 0), or Lutensol$^R$ AO3 (HLB=8; R is a mixture of $C_{13}$ and $C_{15}$ alkyl chains, n is 3 and m is 0), or Tergitol$^R$ 25L3 (HLB=7.7; R is in the range of $C_{12}$ to $C_{15}$ alkyl chain length, n is 3 and m is 0), or Dobanol$^R$ 23-3 (HLB=8.1; R is a mixture of $C_{12}$ and $C_{13}$ alkyl chains, n is 3 and m is 0), or Dobanol$^R$ 23-2 (HLB=6.2; R is a mixture of $C_{12}$ and $C_{13}$ alkyl chains, n is 2 and m is 0), or Dobanol$^R$ 45-7 (HLB=11.6; R is a mixture of $C_{14}$ and $C_{15}$ alkyl chains, n is 7 and m is 0) Dobanol$^R$ 23-6.5 (HLB=11.9; R is a mixture of $C_{12}$ and $C_{13}$ alkyl chains, n is 6.5 and m is 0), or Dobanol$^R$ 25-7 (HLB=12; R is a mixture of $C_{12}$ and $C_{15}$ alkyl chains, n is 7 and m is 0), or Dobanol$^R$ 91-5 (HLB=11.6; R is a mixture of $C_9$ and $C_{11}$ alkyl chains, n is 5 and m is 0), or Dobanol$^R$ 91-6 (HLB=12.5; R is a mixture of $C_9$ and $C_{11}$ alkyl chains, n is 6 and m is 0), or Dobanol$^R$ 91-8 (HLB=13.7; R is a mixture of $C_9$ and $C_{11}$ alkyl chains, n is 8 and m is 0), Dobanol$^R$ 91-10 (HLB=14.2; R is a mixture of $C_9$ to $C_{11}$ alkyl chains, n is 10 and m is 0), or mixtures thereof. Preferred herein are Dobanol$^R$ 91-2.5, or Lutensol$^R$ TO3, or Lutensol$^R$ AO3, or Tergitol$^R$ 25L3, or Dobanol$^R$ 23-3, or Dobanol$^R$ 23-2, or mixtures thereof. These Dobanol$^R$ surfactants are commercially available from SHELL. These Lutensol$^R$ surfactants are commercially available from BASF and these Tergitol$^R$ surfactants are commercially available from UNION CARBIDE.

Other suitable nonionic surfactants for use herein include polyhydroxy fatty acid amide surfactants, or mixtures thereof, according to the formula $$R^2—C(O)—N(R^1)—Z,$$

wherein $R^1$ is H, or $C_1$–$C_4$ alkyl, $C_1$–$C_4$ hydrocarbyl, 2-hydroxy ethyl, 2-hydroxy propyl or a mixture thereof, $R^2$ is $C_5$–$C_{31}$ hydrocarbyl, and Z is a polyhydroxyhydrocarbyl having a linear hydrocarbyl chain with at least 3 hydroxyls directly connected to the chain, or an alkoxylated derivative thereof.

Preferably, $R^1$ is $C_1$–$C_4$ alkyl, more preferably $C_1$ or $C_2$ alkyl and most preferably methyl, $R^2$ is a straight chain $C_7$–$C_{19}$ alkyl or alkenyl, preferably a straight chain $C_9$–$C_{18}$ alkyl or alkenyl, more preferably a straight chain $C_{11}$–$C_{18}$ alkyl or alkenyl, and most preferably a straight chain $C_{11}$–$C_{14}$ alkyl or alkenyl, or mixtures thereof. Z preferably will be derived from a reducing sugar in a reductive amination reaction; more preferably Z is a glycityl. Suitable reducing sugars include glucose, fructose, maltose, lactose, galactose, mannose and xylose. As raw materials, high dextrose corn syrup, high fructose corn syrup, and high maltose corn syrup can be utilised as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2—(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $CH_2—(CHOH)_4—CH_2OH$.

In formula $R^2—C(O)—N(R^1)—Z$, $R^1$ can be, for example, N-methyl, N-ethyl, N-propyl, N-isopropyl, N-butyl, N-2-hydroxy ethyl, or N-2-hydroxy propyl. $R^2—C(O)—N<$ can be, for example, cocamide, stearamide, oleamide, lauramide, myristamide, capricamide, palmitamide, tallowamide and the like. Z can be 1-deoxyglucityl, 2-deoxyfructityl, 1-deoxymaltityl, 1-deoxylactityl, 1-deoxygalactityl, 1-deoxymannityl, 1-deoxymaltotriotityl and the like.

Suitable polyhydroxy fatty acid amide surfactants to be used herein may be commercially available under the trade name HOE® from Hoechst.

Methods for making polyhydroxy fatty acid amide surfactants are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed for example in GB patent specification 809,060, published Feb. 18, 1959, by Thomas Hedley & Co., Ltd., U.S. Pat. No. 2,965,576, issued Dec. 20, 1960 to E. R. Wilson, U.S. Pat. No. 2,703,798, Anthony M. Schwartz, issued Mar. 8, 1955, U.S. Pat. No. 1,985,424, issued Dec. 25, 1934 to Piggott and WO92/06070, each of which is incorporated herein by reference.

The liquid compositions according to the present invention may further comprise other surfactants like an anionic surfactant, or mixtures thereof on top of nonionic surfactants. Anionic surfactants are preferred herein as optional ingredient as they act as wetting agent, i.e., in a laundry application they wet the stains on the fabrics, especially on hydrophilic fabrics, and thus help the peroxygen bleach perform its bleaching action thereby contributing to improved laundry performance on bleachable stains. Furthermore, anionic surfactants allow to obtain clear compositions even when said compositions comprise hydrophobic ingredients such as hydrophobic surfactants. The compositions herein may comprise from 0.1% to 20% by weight of the total composition of said anionic surfactant, or mixtures thereof, preferably from 0.2% to 15% and more preferably from 0.5% to 13%.

Particularly suitable for use herein are sulfonate and sulfate surfactants. The like anionic surfactants are well-known in the art and have found wide application in commercial detergents. These anionic surfactants include the C8–C22 alkyl benzene sulfonates (LAS), the C8–C22 alkyl sulfates (AS), unsaturated sulfates such as oleyl sulfate, the C10–C18 alkyl alkoxy sulfates (AES) and the C10–C18 alkyl alkoxy carboxylates. The neutralising cation for the anionic synthetic sulfonates and/or sulfates is represented by conventional cations which are widely used in detergent technology such as sodium, potassium or alkanolammonium. Preferred herein are the alkyl sulphate, especially coconut alkyl sulphate having from 6 to 18 carbon atoms in the alkyl chain, preferably from 8 to 15, or mixtures thereof.

Other anionic surfactants useful for detersive purposes can also be used herein. These can include salts (including, for example, sodium, potassium, ammonium, and substituted ammonium salts such as mono-, di- and triethanolamine salts) of soap, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), sulfates of alkylpolysaccharides such as the sulfates of alkylpolyglucoside (the nonionic nonsulfated compounds being described below). Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Other suitable anionic surfactants to be used herein also include acyl sarcosinate or mixtures thereof, in its acid and/or salt form, preferably long chain acyl sarcosinates having the following formula:

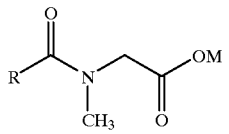

wherein M is hydrogen or a cationic moiety and wherein R is an alkyl group of from 11 to 15 carbon atoms, preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, particularly preferred long chain acyl sarcosinates to be used herein include $C_{12}$ acyl sarcosinate (i.e. an acyl sarcosinate according to the above formula wherein M is hydrogen and R is an alkyl group of 11 carbon atoms) and $C_{14}$ acyl sarcosinate (i.e. an acyl sarcosinate according to the above formula wherein M is hydrogen and R is an alkyl group of 13 carbon atoms). $C_{12}$ acyl sarcosinate is commercially available, for example, as Hamposyl L-30® supplied by Hampshire. $C_{14}$ acyl sarcosinate is commercially available, for example, as Hamposyl M-30® supplied by Hampshire.

The liquid compositions according to the present invention may further comprise other surfactants known to those skilled in the art like an amine oxide surfactant according to the formula R1R2R3NO, wherein each of R1, R2 and R3 is independently a $C_1$–$C_{30}$, preferably a $C_1$–$C_{20}$, most preferably a $C_1$–$C_{16}$ hydrocarbon chain. Amine oxides may be present in amounts up to 10% by weight of the total composition, more preferably from 1% to 3%.

The compositions according to the present invention may further comprise other optional ingredients like builders, stabilizers, chelants, dye transfer agents, radical scavengers, solvents, brighteners, foam suppresors, bleach activators, perfumes, soil suspending polyamine polymers, polymeric soil release agents, catalysts and dyes.

Thus, as an optional but highly preferred ingredient, the compositions according to the present invention comprise a bleach activator or mixtures thereof. By "bleach activator", it is meant herein a compound which reacts with hydrogen peroxide to form a peracid. The peracid thus formed constitutes the activated bleach. Particularly suitable bleach activators to be used herein are hydrophobic bleach activators, i.e., a bleach activator which is not substantially and stably miscible with water. Typically, such hydrophobic bleach activators have a secondary HLB (hydrophilic lipophilic balance) below 11, preferably below 10. Secondary HLB is known to those skilled in the art and is defined for example in "Emulsions theory and practice" by P. Becher, Reinhold, N.Y., 1957, or in "Emulsion science" by P. Sherman, Academic Press, London, 1969.

Suitable bleach activators to be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmentalfriendly as it eventually degrades into citric acid and alcohol. Furthermore, acetyl triethyl citrate has a good hydrolytical stability in the product upon storage and it is an efficient bleach activator. Finally, it provides good building capacity to the composition.

The compositions according to the present invention may comprise from 0.1% to 20% by weight of the total composition of said bleach activator, or mixtures thereof, preferably from 1% to 10%, and more preferably from 2% to 7%.

The compositions herein may be formulated as solutions, emulsions or microemulsions depending on the respective optional ingredients present and respective levels thereof. For example, for stability reasons, the compositions according to the present invention that typically comprise a bleach activator, as described hereinbefore, are preferably formulated either as aqueous emulsions of said bleach activator in a matrix comprising water, the peroxygen bleach, the solvent system and an emulsifying surfactant system, or as microemulsions of said bleach activator in a matrix comprising water, the peroxygen bleach, the solvent system and a hydrophilic surfactant system.

Preferred peroxygen bleach-containing emulsions herein comprise an emulsifying surfactant system of at least two different surfactants. Preferred herein, said two different surfactants should have different HLB values (hydrophilic/lipophilic balance) in order to form stable emulsions, and preferably the difference in value of the HLBs of said two surfactants is at least 1, preferably at least 2. Indeed, by appropriately combining at least two of said surfactants with different HLBs in water, emulsions will be formed which do not substantially separate into distinct layers, upon standing for at least two weeks at 40° C.

The emulsions according to the present invention may further comprise other surfactants on top of said emulsifying surfactant system, which should however not significantly alter the weighted average HLB value of the overall emulsion.

In a particularly preferred embodiment of the emulsions of the present invention, wherein the emulsions comprise acetyl triethyl citrate as the bleach activator, an adequate surfactant system, would comprise a hydrophobic nonionic surfactant with for instance an HLB of 6, such as a Dobanol$^R$ 23-2 and a hydrophilic nonionic surfactant with for instance an HLB of 15, such as a Dobanol$^R$ 91-10. Other suitable nonionic surfactant systems comprise for example a Dobanol$^R$ 23-6.5 (HLB about 12) and a Dobanol$^R$ 23 (HLB below 6) or a Dobanol$^R$ 45-7 (HLB=11.6) and a Dobanol 23-3 (HLB=8.1).

In the embodiment of the present invention where the compositions are formulated as emulsions said compositions are opaque. In centrifugation examination, it was observed that said emulsions herein showed no phase separation after 15 minutes at 6000 rpm. Under microscopic examination, said emulsions appeared as a dispersion of droplets in a matrix.

In the embodiment of the present invention where the compositions of the present invention are formulated as microemulsions, said bleaching microemulsions according to the present invention comprise a hydrophilic surfactant system comprising at least two different surfactants like a nonionic surfactant and an anionic surfactant. Suitable hydrophilic surfactants to be used herein are those hydrophilic surfactants mentioned herein. In the embodiment wherein the microemulsions herein comprise a peroxygen bleach and a bleach activator, a key factor in order to stably incorporate the bleach activator in said microemulsions is that at least one of said surfactants of the hydrophilic surfactant system must have a different HLB value to that of the bleach activator. Indeed, if all said surfactants had the same HLB value as that of the activator, a continuous single phase might be formed, thus lowering the chemical stability of the bleach/bleach activator system. Preferably, at least one of said surfactants has an HLB value which differs by at least 1.0 HLB unit, preferably 2.0 to that of said bleach activator.

In the embodiment of the present invention where the compositions are formulated as microemulsions said compositions are macroscopically transparent in the absence of opacifiers and dyes. In centrifugation examination, it was observed that said microemulsions herein showed no phase separation after 15 minutes at 6000 rpm. Under microscopic examination, said microemulsions appeared as a dispersion of droplets in a matrix. We have observed that the particles had a size which is typically around or below 3 micron diameter.

The bleaching compositions of the present invention, especially those formulated in the form of emulsions or microemulsions are chemically stable. By "chemically stable" it is meant herein that the compositions of the present invention comprising a peroxygen bleach do not undergo more than 10% available oxygen loss at 50° C. in 2 weeks. The concentration of available oxygen can be measured by chemical titration methods known in the art, such as the iodimetric method, the permanganometric method and the cerimetric method. Said methods and the criteria for the choice of the appropriate method are described for example in "Hydrogen Peroxide", W. C. Schumb, C. N. Satterfield and R. L. Wentworth, Reinhold Publishing Corporation, New York, 1955 and "Organic Peroxides", Daniel Swern, Editor Wiley Int. Science, 1970. Alternatively, the stability of said compositions may also be evaluated by a bulging test method.

Accordingly, said bleaching compositions of the present invention may be packaged in a given deformable container/bottle without compromising the stability of said container/bottle comprising it upon standing, for long periods of time.

Suitable chelating agents to be used herein include chelating agents selected from the group of phosphonate chelating agents, amino carboxylate chelating agents, polyfunctionally-substituted aromatic chelating agents, and further chelating agents like glycine, salicylic acid, aspartic acid, glutamic acid, malonic acid, or mixtures thereof. Chelating agents when used, are typically present herein in amounts ranging from 0.001% to 5% by weight of the total composition and preferably from 0.05% to 2% by weight.

Suitable phosphonate chelating agents to be used herein may include ethydronic acid as well as amino phosphonate compounds, including amino alkylene poly (alkylene phosphonate), alkali metal ethane 1-hydroxy diphosphonates, nitrilo trimethylene phosphonates, ethylene diamine tetra methylene phosphonates, and diethylene triamine penta methylene phosphonates. The phosphonate compounds may be present either in their acid form or as salts of different cations on some or all of their acid functionalities. Preferred phosphonate chelating agents to be used herein are diethylene triamine penta methylene phosphonates. Such phosphonate chelating agents are commercially available from Monsanto under the trade name DEQUEST®.

The most preferred phosphonate chelating agent to be used herein is aminotri(methylene phosphonic acid), herein referred to as ATMP. Indeed, it has been found that the addition of ATMP, i.e. the compound of formula:

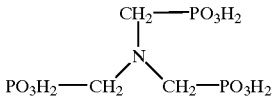

in a liquid composition of the present invention considerably reduces the damage otherwise associated with the pretreatment of fabrics with peroxygen bleach-containing compositions, especially those fabrics which contain metal ions, such as copper, iron, chromium, and manganese.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethyienediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA),N-hydroxyethylethylenediamine triacetates, nitrilotriacetates, ethylenediamine tetrapropionates, triethylenetetraaminehexaacetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Another preferred chelating agent for use herein is of the formula:

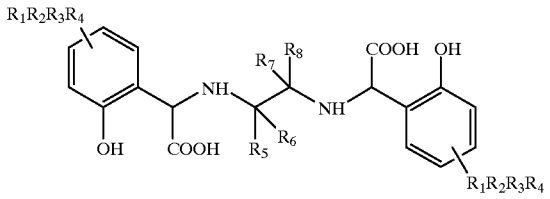

wherein $R_1$, $R_2$, $R_3$, and $R_4$ are independently selected from the group consisting of —H, alkyl, alkoxy, aryl, aryloxy, —Cl, —Br, —$NO_2$, —C(O)R', and —$SO_2$R"; wherein R' is selected from the group consisting of —H, —OH, alkyl, alkoxy, aryl, and aryloxy; R" is selected from the group consisting of alkyl, alkoxy, aryl, and aryloxy; and $R_5$, $R_6$, $R_7$, and $R_8$ are independently selected from the group consisting of —H and alkyl.

Particularly preferred chelating agents to be used herein are ATMP, diethylene triamine methylene phosphonate, ethylene N,N'-disuccinic acid, diethylene triamine pantaacetate, glycine, salicylic acid, aspartic acid, glutamic acid, malonic acid or mixtures thereof and highly preferred is ATMP.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Radical scavengers when used, are typically present herein in amounts ranging from 0.001% to 2% by weight of the total composition and preferably from 0.001% to 0.5% by weight.

The presence of chelating agents, especially ATMP, and/or radical scavengers contributes to the safety profile of the compositions of the present invention suitable for pretreating a soiled colored fabric upon prolonged contact times before washing said fabric.

The compositions according to the present invention may further comprise a soil suspending polyamine polymer or mixtures thereof, as optional ingredient. Any soil suspending polyamine polymer known to those skilled in the art may also be used herein. Particularly suitable polyamine polymers for use herein are polyalkoxylated polyamines. Such materials can conveniently be represented as molecules of the empirical structures with repeating units:

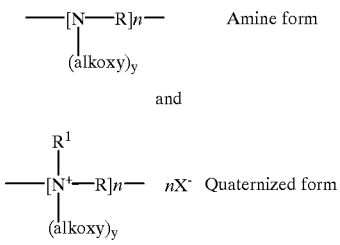

wherein R is a hydrocarbyl group, usually of 2–6 carbon atoms; $R^1$ may be a $C_1$–$C_{20}$ hydrocarbon; the alkoxy groups are ethoxy, propoxy, and the like, and y is 2–30, most preferably from 10–20; n is an integer of at least 2, preferably from 2–20, most preferably 3–5; and $X^-$ is an anion such as halide or methylsulfate, resulting from the quaternization reaction.

The most highly preferred polyamines for use herein are the so-called ethoxylated polyethylene amines, i.e., the polymerized reaction product of ethylene oxide with ethyleneimine, having the general formula:

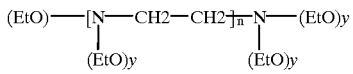

when y=2–30. Particularly preferred for use herein is an ethoxylated polyethylene amine, in particular ethoxylated tetraethylenepentamine, and quaternized ethoxylated hexamethylene diamine.

It has surprisingly been found that said soil suspending polyamine polymers contribute to the benefits of the present invention, i.e., that when added on top of said solvent system in a liquid composition comprising a peroxygen bleach, they further improve the stain removal performance of said composition, especially under laundry pretreatment conditions. Indeed, they allow to improve the stain removal performance on a variety of stains including greasy stains, enzymatic stains, clay/mud stains as well as on bleachable stains.

Typically, the compositions comprise up to 10% by weight of the total composition of such a soil suspending polyamine polymer or mixtures thereof, preferably from 0.1% to 5% and more preferably from 0.3% to 2%.

The compositions herein may also comprise other polymeric soil release agents known to those skilled in the art. Such polymeric soil release agents are characterised by having both hydrophilic segments, to hydrophilize the surface of hydrophobic fibres, such as polyester and nylon, and hydrophobic segments, to deposit upon hydrophobic fibres and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalky ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 1 to about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, co-polymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterised by poly(vinyl ester) hydrophobe segments include graft co-polymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 20 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a co-polymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units which contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are fully described in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoaroyl, end-capped terephthalate esters.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof. See U.S. Pat. No. 5,41 5,807, issued May 16, 1995, to Gosselink et al.

If utilised, soil release agents will generally comprise from about 0.01% to about 10.0%, by weight, of the detergent compositions herein, typically from about 0.1% to about 5%, preferably from about 0.2% to about 3.0%.

The compositions of the present invention may also include one or more materials effective for inhibiting the transfer of dyes from one dyed surface to another during the cleaning process. Generally, such dye transfer inhibiting agents include polyvinyl pyrrolidone polymers, polyamine N-oxide polymers, co-polymers of N-vinylpyrrolidone and N-vinylimidazole, manganese phthalocyanine, peroxidases, and mixtures thereof If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N=; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

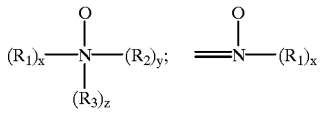

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups.

The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block co-polymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate co-polymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO". The most preferred polyamine N-oxide useful in the detergent compositions herein is poly(4-vinylpyridine-N-oxide) which as an average molecular weight of about 50,000 and an amine to amine N-oxide ratio of about 1:4.

Co-polymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis, Vol* 113. "Modern Methods of Polymer Characterization", the disclosures of which are incorporated herein by reference.) The PVPVI co-polymers typically have a molar ratio of N-vinylimidazole to N-vinylpyrrolidone from 1:1 to 0.2:1, more preferably from 0.8:1 to 0.3:1, most preferably from 0.6:1 to 0.4:1. These co-polymers can be either linear or branched.

The present invention compositions may also employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

If high sudsing is desired, suds boosters such as $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, for example, 0.1%–2%, to provide additional suds and to enhance grease removal performance.

Any optical brighteners, fluorescent whitening agents or other brightening or whitening agents known in the art can be incorporated in the instant compositions when they are designed for fabric treatment or laundering, at levels typically from about 0.05% to about 1.2%, by weight, of the detergent compositions herein. Commercial optical brighteners which may be useful in the present invention can be classified into subgroups, which include, but are not necessarily limited to, derivatives of stilbene, pyrazoline, coumarin, carboxylic acids, methinecyanines, dibenzothiophene-5,5-dioxide, azoles, 5- and 6-membered-ring heterocyclic brighteners, this list being illustrative and non-limiting. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD, available from Hilton-Davis, located in Italy; the 2-(4-styryl-phenyl)-2H-naphthol[1,2-d]triazoles; 4,4'-bis-(1,2,3-triazol-2-yl)-stil-benes; 4,4'-bis(styryl)bisphenyls; and the aminocoumarins. Specific examples of these brighteners include 4-methyl-7-diethyl-amino coumarin; 1,2-bis (benzimidazol-2-yl)ethylene; 2,5-bis(benzoxazol-2-yl) thiophene; 2-styrylnapth-[1,2-d]oxazole; and 2-(stilbene-4-yl)-2H-naphtho-[1,2-d]triazole. See also U.S. Pat. No. 3,646,015, issued Feb. 29, 1972, to Hamilton. Anionic brighteners are typically preferred herein.

If desired, compositions herein may additionally incorporate a catalyst or accelerator to further improve bleaching or soil removal. Any suitable bleach catalyst can be used. For detergent compositions used at a total level of from about 1,000 to about 5,000 ppm in water, the composition will typically deliver a concentration of from about 0.1 ppm to about 700 ppm, more preferably from about 1 ppm to about 50 ppm, or less, of the catalyst species in the wash liquor.

Bleach catalysts may also be used herein. Typical bleach catalysts comprise a transition-metal complex, for example one wherein the metal co-ordinating ligands are quite resistant to labilization and which does not deposit metal oxides or hydroxides to any appreciable extent under the typically alkaline conditions of washing. Such catalysts include manganese-based catalysts disclosed in U.S. Pat. Nos. 5,246,621, 5,244,594; 5,194,416; 5,114,606; and EP Nos. 549,271 A1, 549,272 A1, 544,440 A2, and 544,490 A1; preferred examples of these catalysts include $Mn^{IV}{}_2(\mu\text{-}O)_3(TACN)_2\text{—}(PF_6)_2$, $Mn^{III}{}_2(\mu\text{-}O)_1(\mu\text{-}OAc)_2(TACN)_2(ClO_4)_2$, $Mn^{IV}{}_4(\mu\text{-}O)_6(TACN)_4(ClO_4)_4$, $Mn^{III}Mn^{IV}{}_4\text{—}(\mu\text{-}O)_1(\mu\text{-}OAc)_2\text{—}(TACN)_2\text{—}(ClO_4)_3$, $Mn^{IV}\text{-}(TACN)\text{—}(OCH_3)_3(PF_6)$, and mixtures thereof wherein TACN is trimethyl-1,4,7-triazacyclononane or an equivalent macrocycle; though alternate metal-co-ordinating ligands as well as mononuclear complexes are also possible and monometallic as well as di- and polymetallic complexes and complexes of alternate metals such as iron or ruthenium are all within the present scope. Other metal-based bleach catalysts include those disclosed in U.S. Pat. Nos. 4,430,243 and 5,114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; and 5,227,084.

Transition metals may be precomplexed or complexed in-situ with suitable donor ligands selected in function of the choice of metal, its oxidation state and the denticity of the ligands. Other complexes which may be included herein are those of U.S. application Ser. No. 08/210,186, filed Mar. 17, 1994.

Depending on the end-use envisioned, the compositions herein can be packaged in a variety of containers including conventional bottles, bottles equipped with roll-on, sponge, brusher or sprayers, or sprayers.

Although the preferred application of the liquid compositions described herein is laundry application, as a laundry detergent or as a laundry additive and especially as a pretreater such compositions may also be used to clean hard-surfaces.

The invention is further illustrated by the following examples.

EXAMPLES

Example 1

A liquid composition is prepared which comprises:

| | (weight %) |
|---|---|
| Hydrogen peroxide | 6% |
| ATC | 2% |
| Benzyl alcohol (HI = 16) | 2% |
| Pinene (HI = 0) | 1% |
| Ethoxyethoxy ethanol (HI = 37) | 4% |
| Dobanol ® 23.3 | 8.6% |
| Dobanol ® 45.7 | 6.4% |
| C12 Alkyl Sulfate | 2% |
| Water and minors | up to 100% |

pH = 4, trimmed with Sulphuric acid

In a pretreatment mode, this composition is applied neat on the stained portion of a fabric and left to act thereon for 5 minutes. Then the fabric is washed with a conventional detergent and rinsed. Excellent stain removal is obtained therewith on various stains including greasy stains, enzymatic stains, clay stains and bleachable stains.

Example 2

A liquid composition is prepared which comprises:

| | (weight %) |
|---|---|
| Hydrogen peroxide | 4.0% |
| ATC | 3.5% |
| Benzyl alcohol (HI = 16) | 2% |
| Methoxy Propanol (HI = 37) | 5% |
| Limonene (HI = 0) | 1% |
| Dobanol ® 23.3 | 8.6% |
| Dobanol ® 45.7 | 6.4% |
| C12 Alkyl Sulfate | 2% |
| Water and minors | up to 100% |

pH = 4, trimmed with Sulphuric acid

In a pretreatment mode, this composition is applied neat on the stained portion of a fabric and left to act thereon for 5 minutes. Then the fabric is washed with a conventional detergent and rinsed. Excellent stain removal is obtained therewith on various stains including greasy stains, enzymatic stains, clay stains and bleachable stains.

Example 3

The following liquid composition is prepared:

| | (weight %) |
|---|---|
| Hydrogen peroxide | 6.0% |
| ATC | 3.5% |
| Benzyl alcohol (HI = 16) | 1% |
| Pinene (HI = 0) | 0.5% |
| Propoxy propanol (HI = 28) | 5% |
| Dobanol ® 45.7 | 6.0% |
| Dobanol ® 23.6,5 | 6.0% |
| C25-AE2.5-S (ethoxylated alkyl sulfate) | 12.0% |
| Water and minors | up to 100% |

pH = 4, trimmed with Sulphuric acid

In a bleaching-through-the-wash mode, this composition is contacted with an aqueous bath formed by dissolution of a conventional detergent in water. Fabrics are then contacted with the aqueous bath comprising the liquid detergent, and the fabrics are rinsed. This composition can also be used in a pretreatment mode, where it is poured neat on the stains on the fabrics, and left to act for 5 minutes, and the fabrics are washed. Excellent stain removal is obtained on various stains including greasy stains, enzymatic stains, clay stains and bleachable stains.

Example 4

The following liquid composition is prepared:

| | (weight %) |
|---|---|
| tert-Butyl Hydroperoxide | 5% |
| EthoxyEthoxyEthanol (HI = 37) | 8% |
| Limonene (HI = 0) | 2% |
| Dobanol ® 91.10 | 1.6% |
| Dobanol ® 23.3 | 1.5% |
| C10 Alkyl sulphate | 1.7% |
| Isofol 12 ® | 0.5% |
| Water and minors | up to 100% |

pH = 4, trimmed with Sulphuric acid

This composition can be used in a pretreatment mode, or in a bleaching-through-the-wash mode, as described in previous examples. It can also be used in a soaking mode, where 100 ml of the liquid compositions are diluted in 10 liters of water. The fabrics are then contacted with this aqueous bath containing the composition, and left to soak therein for a period of time of 24 hours. The fabrics are eventually rinsed. Excellent stain removal is obtained therewith on various stains including greasy stains, enzymatic stains, clay stains and bleachable stains.

Example 5

The following liquid composition is prepared:

| | (weight %) |
|---|---|
| tert-Butyl Hydroperoxide | 5% |
| EthoxyEthoxyEthanol (HI = 37) | 8% |

-continued

| | (weight %) |
|---|---|
| Pimene (HI = 0) | 2% |
| Dobanol ® 91.10 | 1.6% |
| Dobanol ® 23.3 | 1.5% |
| C10 Alkyl sulphate | 1.7% |
| Isofol 12 ® | 0.5% |
| Water and minors | up to 100% |

pH = 4, trimmed with Sulphuric acid

This composition can be used in a pretreatment mode, or in a bleaching-through-the-wash mode, as described in previous examples. It can also be used in a soaking mode, where 100 ml of the liquid compositions are diluted in 10 liters of water. The fabrics are then contacted with this aqueous bath containing the composition, and left to soak therein for a period of time of 24 hours. The fabrics are eventually rinsed. Excellent stain removal is obtained therewith on various stains including greasy stains, enzymatic stains, clay stains and bleachable stains.

Example 6

The following liquid composition is prepared:

| | (weight %) |
|---|---|
| H2O2 | 7% |
| EthoxyEthoxyEthanol (HI = 37) | 1% |
| Limonene (HI = 0) | 0.2% |
| Dobanol ® 91.10 | 1.6% |
| Dobanol ® 23.3 | 1.5% |
| C10 AS | 1.7% |
| Isofol 12 ® | 0.5% |
| Water and minors | up to 100% |

pH = 4, trimmed with Sulphuric acid

This composition can be used in a pretreatment mode, or in a bleaching-through-the-wash mode, as described in examples 1 and 2. It can also be used in a soaking mode, where 100 ml of the liquid compositions are diluted in 10 liters of water. The fabrics are then contacted with this aqueous bath containing the composition, and left to soak therein for a period of time of 24 hours. The fabrics are eventually rinsed. Excellent stain removal is obtained therewith on various stains including greasy stains, enzymatic stains, clay stains and bleachable stains.

Example 7

A liquid detergent composition is prepared as follows:

| | (weight %) |
|---|---|
| Cumyl Hydroperoxide | 10% |
| Ethoxyethoxy ethanol (HI = 37) | 4.0% |
| Benzyl alcohol (HI = 16) | 1.5% |
| Dobanol ® 23.3 | 8.6% |
| Dobanol ® 45.7 | 6.4% |
| C12 AS | 2% |
| Water and minors | up to 100% |

pH = 6, trimmed with Sulphuric acid

This composition is used in a pretreatment mode, as described in the examples above. Excellent stain removal is obtained therewith on various stains including greasy stains, enzymatic stains, clay stains and bleachable stains.

Example 8

The following liquid composition is made:

| | (weight %) |
|---|---|
| 2,5-dimethyl-hexane-2,5-dihydroperoxide | 5% |
| Propoxy propanol (HI = 28) | 8% |
| Pinene (HI = 0) | 1.0% |
| Dobanol ® 23.3 | 8.6% |
| Dobanol ® 45.7 | 6.4% |
| C25-2.5EO-S | 2% |
| Water and minors | up to 100% |

pH = 5, trimmed with Sulphuric acid

This composition is used in a pretreatment mode as described in the previous examples. Excellent stain removal is obtained therewith on various stains including greasy stains, enzymatic stains, clay stains and bleachable stains.

Example 9

The following liquid composition is made:

| | (weight %) |
|---|---|
| Dilauroyl peroxide | 2.0% |
| Methoxy propanol (HI = 37) | 4.0% |
| Benzyl alcohol (HI = 16) | 1.0% |
| Dobanol ® 23.3 | 8.6% |
| Dobanol ® 45.7 | 6.4% |
| C12 alkyl suphate | 1.0% |
| Water and minors | up to 100% |

pH = 5, trimmed with Sulphuric acid

This composition is used in a pretreatment mode as described in the previous examples. Excellent stain removal is obtained therewith on various stains including greasy stains, enzymatic stains, clay stains and bleachable stains.

Example 10

The following liquid composition is made:

| | (weight %) |
|---|---|
| Dilauroyl peroxide | 0.5% |
| Hydrogen peroxide | 4.0% |
| ATC | 2.0% |
| Methoxy propanol (HI = 37) | 5.0% |
| Benzyl alcohol (HI = 16) | 2.0% |
| Limonene (HI = 0) | 0.5% |
| Dobanol ® 23.3 | 8.6% |
| Dobanol ® 45.7 | 6.4% |
| C25-2.5EO-S | 2% |
| Water and minors | up to 100% |

pH = 5, trimmed with Sulphuric acid

In the previous examples ATC stands for acetyl triethyl citrate.

This composition is used in a pretreatment mode as described in the previous examples. Excellent stain removal is obtained therewith on various stains including greasy stains, enzymatic stains, clay stains and bleachable stains.

Example 11

The following liquid composition is prepared:

| | (weight %) |
|---|---|
| Didecanoyl peroxide | 0.5% |
| Hydrogen peroxide | 7.0% |
| Ethoxy propanol (HI = 32) | 1.0% |
| Limonene (HI = 0) | 0.2% |
| Dobanol ® 91.10 | 1.5% |
| C10 Alkyl sulphate | 1.7% |
| Water and minors | up to 100% |

pH = 4, trimmed with Sulphuric acid

This composition can be used in a pretreatment mode, or in a bleaching-through-the-wash mode, as described in previous examples. Excellent stain removal is obtained therewith on various stains including greasy stains, enzymatic stains, clay stains and bleachable stains.

What is claimed is:

1. A process of bleaching a fabric with an aqueous liquid composition comprising a peroxygen bleach and a solvent system comprising a hydrophilic organic solvent having a hydrophilic index of more than 18, and a hydrophobic organic solvent having a hydrophilic index of less than 18, wherein said composition has a pH of from 1 to 6, and wherein the hydrophilic index is defined by the equation $$\frac{\text{molecular weight of the hydrophilic part of the solvent}}{\text{total molecular weight of the solvent}} * 100,$$

said process comprising the steps of applying said composition in its neat form onto said fabric, before rinsing or washing, then rinsing said fabric.

2. A process according to claim 1, wherein said neat composition is allowed to remain in contact with said fabric for a period of time ranging from 1 minute to 1 hour.

3. A process according to claim 2, wherein said neat composition is allowed to remain in contact with said fabric for a period of time ranging from 1 minute to 30 minutes.

4. A process of bleaching fabrics which includes the steps of diluting in an aqueous bath an aqueous liquid composition in its neat form, said composition comprising a peroxygen bleach one or more other ingredients selected from the group consisting of radical scavengers, soil suspending polyamine polymers, other polymeric soil release agents, dye transfer inhibiting agents, suds boosting agents, bleach catalysts and mixtures thereof, and a solvent system comprising a hydrophilic organic solvent having a hydrophilic index of more than 18, and a hydrophobic organic solvent having a hydrophilic index of less than 18, wherein said composition has a pH of from 1 to 6, and wherein the hydrophilic index is defined by the equation $$\frac{\text{molecular weight of the hydrophilic part of the solvent}}{\text{total molecular weight of the solvent}} * 100,$$

contacting said fabrics with said aqueous bath comprising said liquid composition, and subsequently rinsing, or washing then rinsing said fabrics.

5. A process according to claim 4, wherein the fabrics are left to soak in said aqueous bath comprising said liquid composition for a period of time ranging from 30 minutes to 48 hours.

6. A process according to claim 5, wherein the fabrics are left to soak in said aqueous bath comprising said liquid composition for a period of time ranging from 1 hour to 24 hours.

7. A process according to claim 6, wherein said aqueous bath is formed by dissolving or dispersing a conventional laundry detergent in water.

8. A process according to claim 1, wherein said neat composition comprises from 0.01% to 20% by weight of the total composition of a peroxygen bleach or mixtures thereof.

9. A process according to claim 8, wherein said neat composition comprises from 1% to 10% by weight of the total composition of a peroxygen bleach or mixtures thereof.

10. A process according to claim 1 wherein said hydrophilic solvent is an alkoxylated aliphatic or aromatic alcohol having a hydrophilic index of more than 18, an aliphatic or aromatic alcohol having a hydrophilic index of more than 18, glycol or alkoxylated glycol having a hydrophilic index of more than 18, or mixtures thereof.

11. A process according to claim 1 wherein said hydrophilic solvent is ethanol, propanol, methoxy propanol, ethoxy propanol, propoxy propanol, buthoxy propanol, propanediol, ethoxy-ethoxy-ethanol or mixtures thereof.

12. A process according to claim 1 wherein said hydrophobic solvent is a paraffin, a terpene or a terpene derivative having a hydrophilic index of less than 18, an alkoxylated aliphatic or aromatic alcohol having a hydrophilic index of less than 18, an aliphatic or aromatic alcohol having a hydrophilic index of less than 18, glycol or alkoxylated glycol having a hydrophilic index of less than 18, or mixtures thereof.

13. A process according to claim 1 wherein said hydrophobic solvent is d-limonene, dipentene, alpha-pinene, beta-pinene, octane, benzyl alcohol or mixtures thereof.

14. A process according to claim 1 wherein said composition comprises from 0.1% to 5% by weight of the total composition of a hydrophobic solvent or mixtures thereof.

15. A process according to claim 1 wherein said composition comprises from 0.5% to 15% by weight of the total composition of a hydrophilic solvent or mixtures thereof.

16. A process according to claim 1 wherein said composition comprises from 0.2% to 2% by weight of the total composition of a hydrophobic solvent or mixtures thereof.

17. A process according to claim 1 wherein said composition comprises from 1% to 10% by weight of the total composition of a hydrophilic solvent or mixtures thereof.

18. A process according to claim 1 wherein said composition has a pH of from 2 to 6.

19. An aqueous liquid composition suitable for bleaching fabrics, comprising a peroxygen bleach, one or more other ingredients selected from the group consisting of radical scavengers, soil suspending polyamine polymers, other polymeric soil release agents, dye transfer inhibiting agents, suds boosting agents, bleach catalysts and mixtures thereof, and a solvent system comprising from 0.05% to 20% by weight of the total composition of a hydrophilic organic solvent having a hydrophilic index of more than 18, and from 0.05% to 10% by weight of the total composition of a hydrophobic organic solvent having a hydrophilic index of less than 18, wherein said composition has a pH of from 1 to 6, and wherein the hydrophilic index is defined by the equation $$\frac{\text{molecular weight of the hydrophilic part of the solvent}}{\text{total molecular weight of the solvent}} * 100.$$

20. A composition according to claim 19 wherein said composition comprises from 0.01% to 20% by weight of the total composition of a peroxygen bleach or mixtures thereof.

21. A composition according to claim 19 wherein said neat composition comprises from 1% to 10% by weight of the total composition of a peroxygen bleach or mixtures thereof.

22. A composition according to claim 19 wherein said hydrophilic solvent is an alkoxylated aliphatic or aromatic alcohol having a hydrophilic index of more than 18, an aliphatic or aromatic alcohol having a hydrophilic index of more than 18, glycol or alkoxylated glycol having a hydrophilic index of more than 18, or mixtures thereof.

23. A composition according to claim 19 wherein said hydrophilic solvent is ethanol, propanol, methoxy propanol, ethoxy propanol, propoxy propanol, buthoxy propanol, propanediol, ethoxy-ethoxy-ethanol or mixtures thereof.

24. A composition according to claim 19 wherein said hydrophobic solvent is a paraffin, a terpene or a terpene derivative having a hydrophilic index of less than 18, an alkoxylated aliphatic or aromatic alcohol having a hydrophilic index of less than 18, an aliphatic or aromatic alcohol having a hydrophilic index of less than 18, glycol or alkoxylated glycol having a hydrophilic index of less than 18, or mixtures thereof.

25. A composition according to claim 19 wherein said hydrophobic solvent is d-limonene, dipentene, alpha-pinene, beta-pinene, octane, benzyl alcohol or mixtures thereof.

26. A composition according to claim 19 wherein said composition comprises from 0.1% to 5% by weight of the total composition of a hydrophobic solvent or mixtures thereof.

27. A composition according to claim 19 wherein said composition comprises from 0.5% to 15% by weight of the total composition of a hydrophilic solvent or mixtures thereof.

28. A composition according to claim 19 wherein said composition comprises from 0.2% to 2% by weight of the total composition of a hydrophobic solvent or mixtures thereof.

29. A composition according to claim 19 wherein said composition comprises from 1% to 10% by weight of the total composition of a hydrophilic solvent or mixtures thereof.

30. A composition according to claim 19 wherein said composition has a pH of from 2 to 6.

31. A process according to claim 1 wherein said peroxygen bleach is selected from the group consisting of percarbonate, persilicate, persulphate, perborate, peroxyacids, alkyl hydroperoxides, peroxides, aliphatic diacyl peroxides and mixtures thereof.

32. A process according to claim 1 wherein the composition further comprises a hydrophobic nonionic surfactant having an HLB below 16 and mixtures thereof.

33. A composition according to claim 19 wherein said peroxygen bleach is selected from the group consisting of percarbonate, persilicate, persulphate, perborate, peroxyacids, alkyl hydroperoxides, peroxides, aliphatic diacyl peroxides and mixtures thereof.

34. A composition according to claim 19 wherein the composition further comprises a hydrophobic nonionic surfactant having an HLB below 16 and mixtures thereof.

* * * * *